US010817009B2

(12) United States Patent
DeCarr et al.

(10) Patent No.: US 10,817,009 B2
(45) Date of Patent: Oct. 27, 2020

(54) OFFSET OPERATOR MECHANISM FOR CONTROL ENCLOSURE

(71) Applicant: Eaton Intelligent Power Limited, Dublin (IE)

(72) Inventors: Graig Edmund DeCarr, Cicero, NY (US); Adam Ledgerwood, Syracuse, NY (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/283,063

(22) Filed: Feb. 22, 2019

(65) Prior Publication Data

US 2019/0265745 A1 Aug. 29, 2019

Related U.S. Application Data

(60) Provisional application No. 62/634,486, filed on Feb. 23, 2018.

(51) Int. Cl.

| | |
|---|---|
| ***G05G 1/02*** | (2006.01) |
| ***H01H 3/02*** | (2006.01) |
| ***H01H 9/04*** | (2006.01) |
| *G05G 5/05* | (2006.01) |

(52) U.S. Cl.

CPC ..... *G05G 1/02* (2013.01); *H01H 3/02* (2013.01); *H01H 9/042* (2013.01); *G05G 5/05* (2013.01); *G05G 2505/00* (2013.01)

(58) Field of Classification Search

CPC ..... H01H 9/22; H01H 9/045; H01H 3/06; H01H 3/54; H01H 71/50; G05G 1/00; G05G 1/02; G05G 1/04; G05G 1/54

See application file for complete search history.

(56) References Cited

U.S. PATENT DOCUMENTS

| | | | | |
|---|---|---|---|---|
| 3,392,593 A * | 7/1968 | Paape | ..... | H01H 3/12 74/110 |
| 10,263,400 B2 * | 4/2019 | Taaffe | ..... | H01H 71/56 |
| 10,310,542 B2 * | 6/2019 | Butler | ..... | G05G 1/54 |

* cited by examiner

*Primary Examiner* — Vanessa Girardi
(74) *Attorney, Agent, or Firm* — Stinson LLP

(57) ABSTRACT

An operator mechanism comprises a mechanical user interface and a contact assembly. The mechanical user interface is configured to be physically moved by a user. The contact assembly is coupled to the mechanical user interface such that movement of the mechanical user interface imparts movement to the contact assembly. The contact assembly includes a shaft having a longitudinal axis extending distally outward relative to the mechanical user interface to a distal end of the shaft. The contact assembly also includes a contact member coupled to and extending radially outward from the shaft. The contact member engages an actuator of a control device in the control enclosure when the contact assembly is moved. The contact member is selectively positionable longitudinally along the shaft and defines a shaft opening the shaft extends through such that the distal end of the shaft is distal of the shaft opening.

13 Claims, 13 Drawing Sheets

OFFSET OPERATOR MECHANISM FOR CONTROL ENCLOSURE

CROSS-REFERENCE TO RELATED APPLICATIONS

This application claims the benefit of U.S. Provisional Application No. 62/634,486, filed Feb. 23, 2018, the entirety of which is hereby incorporated by reference.

FIELD OF THE DISCLOSURE

The present disclosure generally relates to an operator mechanism for a control enclosure.

BACKGROUND OF THE DISCLOSURE

Operator mechanisms are used to interface with control systems housed within control enclosures. Such operator mechanisms include, for example, push buttons, rotary switches, and swing handles, among others. The operator mechanisms are mounted on a wall (e.g., door) of the control enclosures to allow an operator to actuate the operator mechanism from outside the enclosure to perform some operation with the control devices housed in the enclosure.

Conventional operator mechanisms, illustrated in FIGS. 1A and 1B, have an in-line design where the actuator 8 of the control device, typically a push-button or lever, engaged by the operator mechanism is located directly behind or "in-line" with the operator mechanism. This operator mechanism, generally indicated at reference numeral 1, is shown mounted on a door 2 of a control enclosure, generally indicated at 6. These conventional operator mechanisms typically include a button 3 on the door of the control enclosure, an operator shaft 5 coupled to the button and a threaded extender 7 threaded on the distal end of the operator shaft. The longitudinal position of the extender 7 on the operator shaft 5 can be adjusted to a desired position so the distal end of the extender engages the actuator of the device when the button 3 is depressed (i.e. the button is pushed inward toward the door 2). A jam nut 9 is also threaded onto the operator shaft 5 to inhibit longitudinal movement of the extender 7 once the extender is in the desired position. The operator mechanism 1 is positioned on the door 2 such that the actuator 8 of the control device is aligned with the longitudinal axis of the shaft (e.g., an inline arrangement). When the button 3 is operated by the user (i.e. when the button is depressed), the distal end of the threaded extender 7 engages the actuator 8 of the control device. In effect, the actuator 8 of the control device is in-line with the longitudinal axis of the operator shaft 5 and extender 7 so that the distal end of the extender contacts the actuator 8 when operated by the user.

SUMMARY OF THE INVENTION

In one aspect, an operator mechanism for a control enclosure having proximal and distal ends comprises a mechanical user interface adjacent the proximal end of the operator mechanism. The mechanical user interface is configured to be physically moved by a user to actuate the operator mechanism. A contact assembly is coupled to the mechanical user interface such that movement of the mechanical user interface by the user imparts movement to the contact assembly in one of distal and proximal directions. The contact assembly includes a shaft having a longitudinal axis extending distally outward relative to the mechanical user interface to a distal end of the shaft. A contact member is coupled to and extending radially outward from the shaft and is configured to engage an actuator of a control device in the control enclosure when the contact assembly is moved in said one of the distal and proximal directions by the mechanical user interface. The contact member is selectively positionable longitudinally along the shaft to adjust a longitudinal position of the contact member on the shaft. The contact member defines a shaft opening extending through the contact member. The shaft extends through the shaft opening such that the distal end of the shaft is distal of the shaft opening.

In another aspect, a control enclosure comprises a housing including at least one wall defining an interior configured to house a control device and an operator mechanism. The operator mechanism has proximal and distal ends and is secured to the at least one wall. The operator mechanism is configured to selectively engage the control device in the interior. The operator mechanism comprises a mechanical user interface adjacent the proximal end of the operator mechanism. The mechanical user interface is configured to be physically moved by a user to actuate the operator mechanism. A shaft has a longitudinal axis and extends distally outward relative to the mechanical user interface to a distal end of the shaft. A contact member is coupled to and extends radially outward from the shaft. The contact member is configured to engage an actuator of the control device radially spaced apart from the longitudinal axis when the contact member is moved in said one of the distal and proximal directions by the mechanical user interface.

In another aspect, an operator mechanism for a control enclosure having proximal and distal ends comprises a mechanical user interface adjacent the proximal end of the operator mechanism. The mechanical user interface is configured to be physically moved by a user to actuate the operator mechanism. A contact assembly is coupled to the mechanical user interface such that movement of the mechanical user interface by the user imparts movement to the contact assembly in one of distal and proximal directions. The contact assembly includes a shaft having a longitudinal axis extending distally outward relative to the mechanical user interface to a distal end of the shaft. A contact member is coupled to and extends radially outward from the shaft. The contact member is configured to engage an actuator of a control device in the control enclosure when the contact assembly is moved in said one of the distal and proximal directions by the mechanical user interface. The contact member has an adjustable footprint.

Other objects and features of the present disclosure will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE DISCLOSURE

In general, the operator mechanism disclosed herein provides offset position arrangements with respect to an actuator of a control device and continuous height adjustments so that the operator mechanism can be used with different control enclosures and/or with different control devices.

Figure 2:
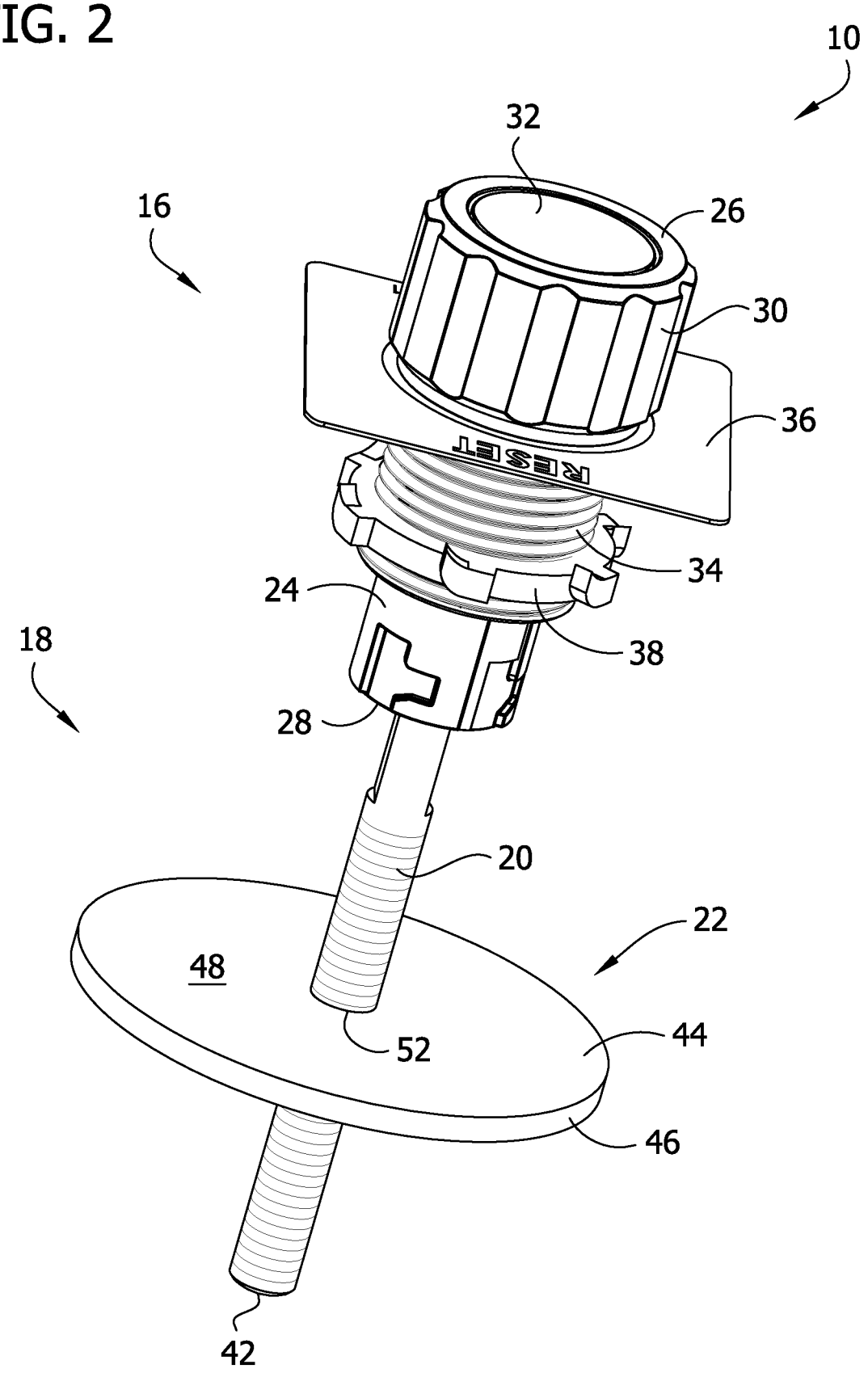
FIG. 2 is a perspective of one embodiment of an operator mechanism constructed according to the teachings of the present disclosure.
Figure 4:
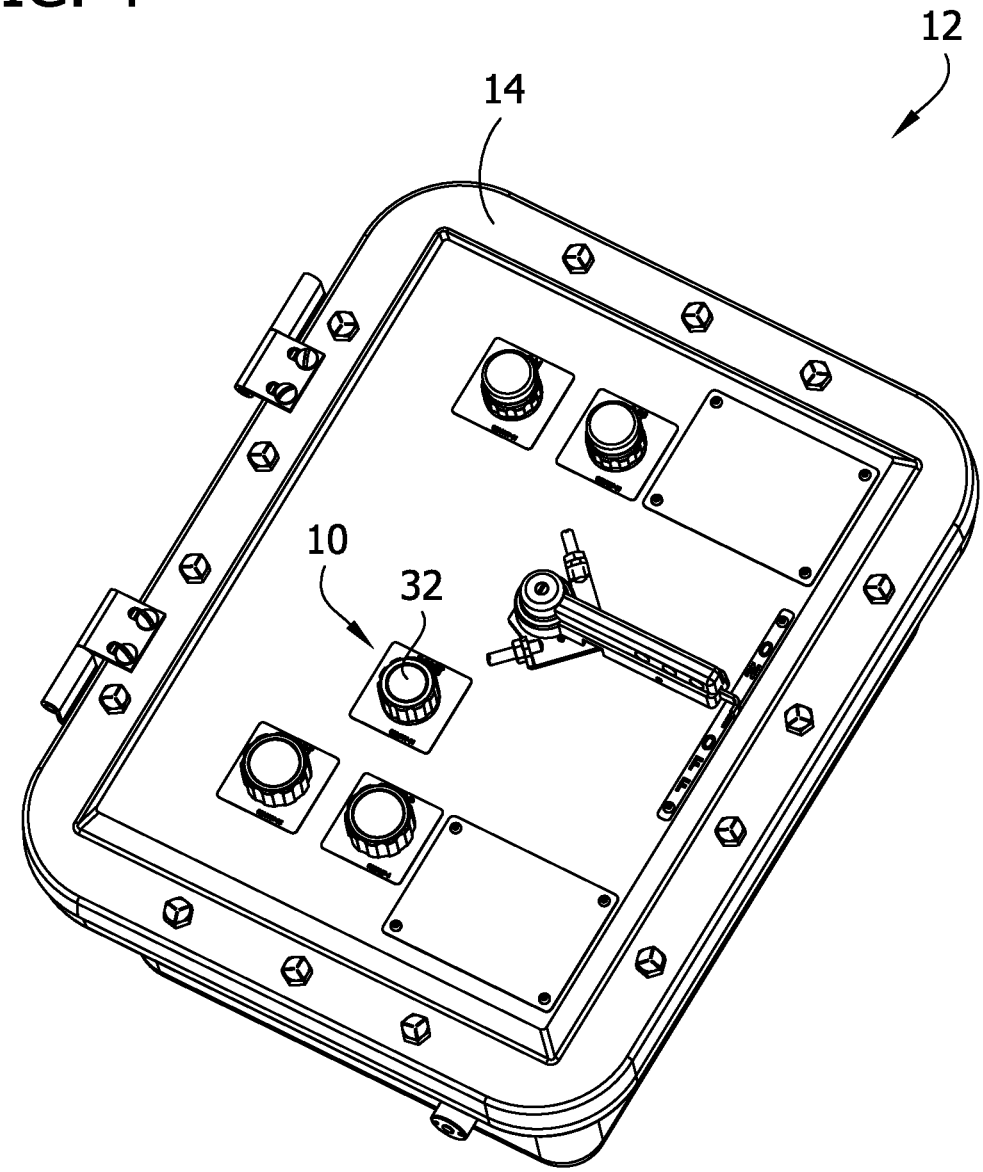
FIG. 4 is a perspective of a control enclosure including the operator mechanism of FIG. 2 mounted on a door of the control enclosure.

Referring to FIG. 2, an operator mechanism for a control enclosure is generally indicated at reference numeral 10. The operator mechanism 10 is configured to be mounted on a control enclosure, such as the illustrated enclosure generally indicated at reference numeral 12 illustrated in FIGS. 4-8. As is generally known in the art, the control enclosure 12 may house electrical controls or other electrical devices, broadly, a control device generally indicated at 13, for controlling and/or operating devices and systems. The control enclosure 12 can have various shapes and sizes depending upon the type of enclosure and the type and/or size of control devices houses therein. For example, in one embodiment the control enclosure may be configured to house a motor controller, such as a motor starter. The control enclosure 12 may be a general purpose enclosure or an explosion proof enclosure. The enclosure 12 includes one or more walls defining an interior of the control enclosure, and in one embodiment, one of the walls is a door 14, as shown in FIG. 4, providing access to the interior of the control enclosure. The operator mechanism 10 may be mounted on the door 14 or other wall of the enclosure 12. In general, the illustrated operator mechanism 10 is configured as a push button operator mechanism. It is understood that the teachings set forth herein may be employed in other operator mechanism embodiments, including a pull button operator mechanism or a lever operator mechanism, for example.

In general, and as explained in more detail below, the operator mechanism 10 is offset or generally positioned to the side of the control device 13 that is operated by the operator mechanism. Moreover, the operator mechanism 10 is selectively adjustable to allow the operator mechanism to be used with different types of control enclosures and/or different types of control devices housed within the control enclosure. The illustrated operator mechanism 10 is configured as a push button operator mechanism. It is understood that the teachings set forth herein may be employed in other operator mechanism embodiments, including a pull button operator mechanism, for example.

Figure 1A:
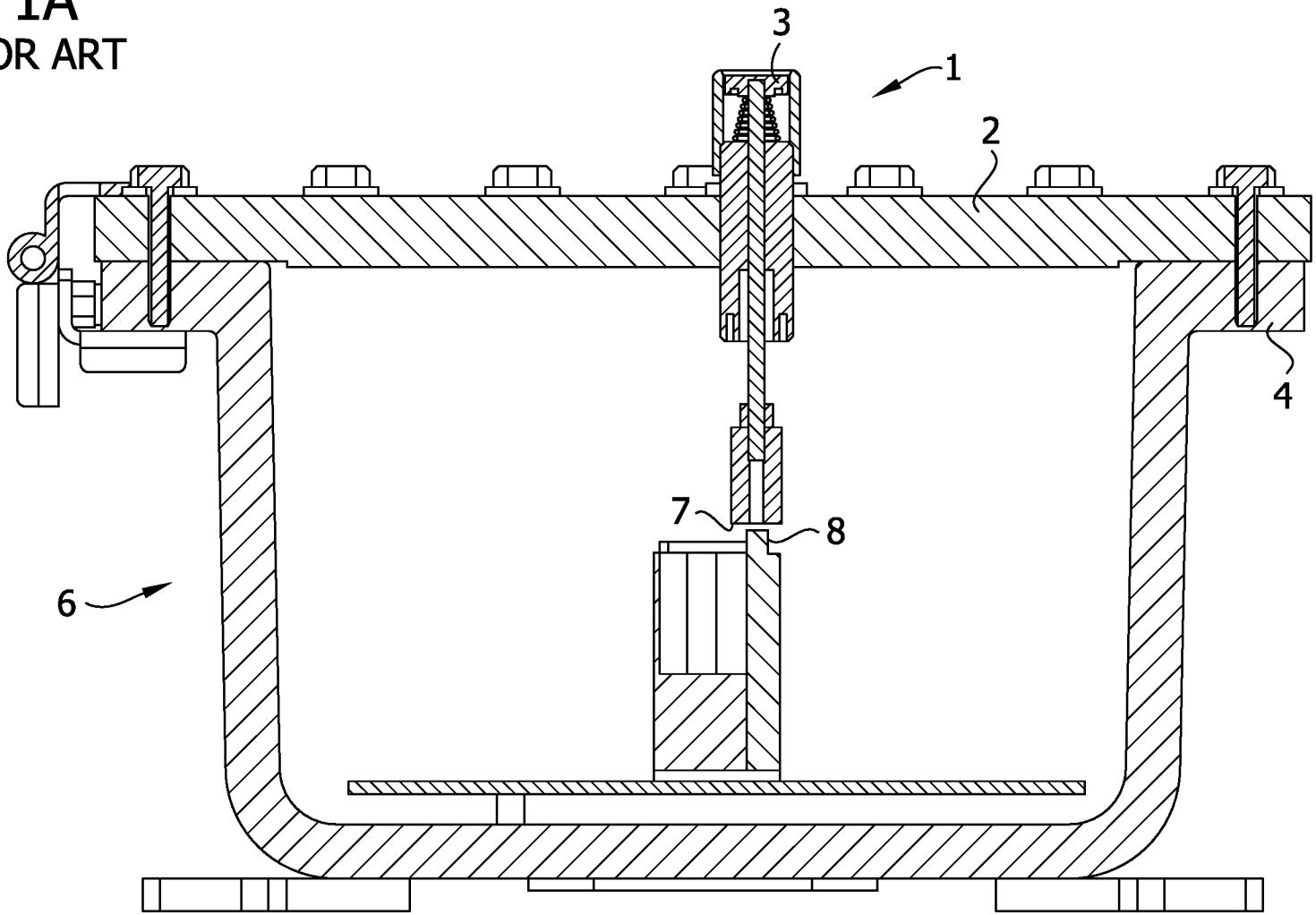
FIG. 1A PRIOR ART
FIG. 1A is a cross section of a control enclosure including a conventional operator mechanism mounted on a door of the control enclosure.
Figure 1B:
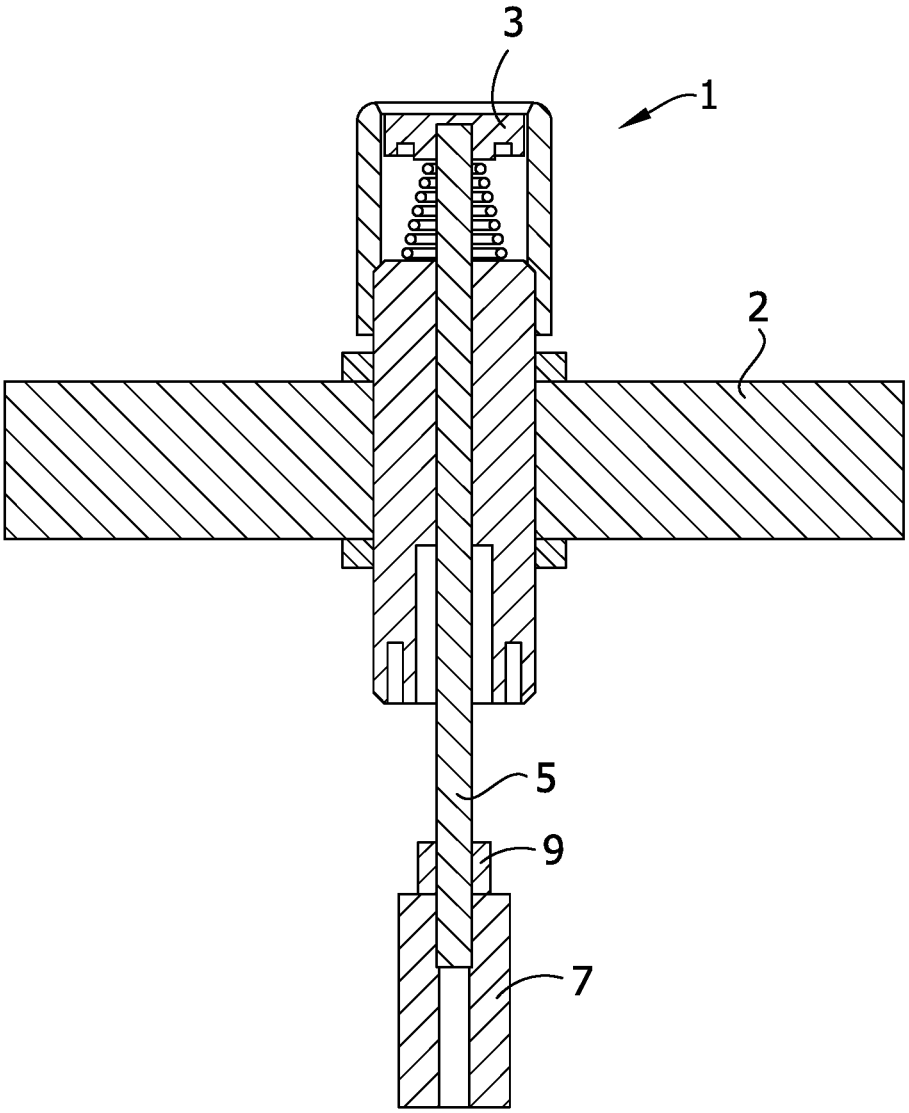
FIG. 1B PRIOR ART
FIG. 1B is an enlarged view of the conventional operator mechanism mounted on the door of the control enclosure.
Figure 3:
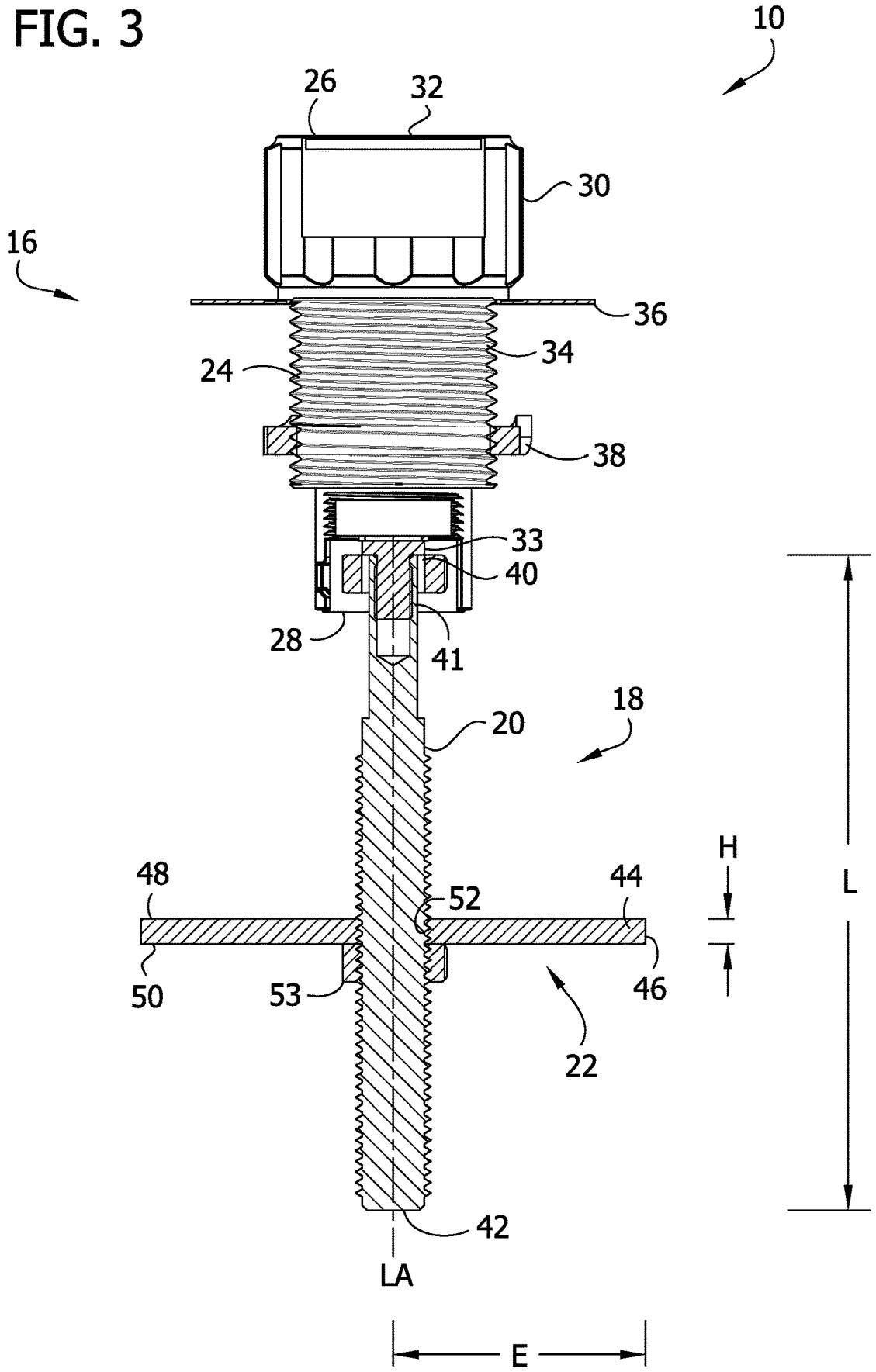
FIG. 3 is a longitudinal section of the operator mechanism of FIG. 2.

As shown best in FIGS. 2 and 3, in general the push button operator mechanism 10 comprises a button assembly 16 having a cylindrical-shaped body 24 having a proximal end 26 and a distal end 28. As used herein, the terms "proximal," "distal," and like terms, are used for convenience to describe relative positions and locations of the components and structures of the operator mechanism 10 and are not meant in a limiting sense. A button 32 (broadly, a mechanical user interface) is positioned at the proximal end 26 of the button assembly 16. The body 24 includes a button shroud 30 to protect the button 32. A button shroud opening in the proximal end of the shroud 30 allows access to the button 32. The button 32 is longitudinally movable or slidable within the body 24 between a proximal (i.e. initial or non-depressed position) and a distal (i.e. depressed) position. The button 32 is configured to be engaged by the user to depress or slide the button distally within the button shroud 30 of the body 24. The button assembly 16 includes a spring (e.g. a compression spring), such as shown in the conventional operator mechanism of FIGS. 1A and 1B, that engages the body 24 to bias the button 32 in the proximal position. In the illustrated embodiment, the button 32 is attached to a shaft attachment portion 33 that is positioned at the distal end 28 of the button assembly 16. The shaft attachment portion 33 is configured to be longitudinally movable or slidable within the body 24 such that when the button 32 is moved by the user, the shaft attachment portion 33 moves as well. As explained in more detail below, the shaft attachment portion 33 is configured to couple to a shaft 20 of a contact assembly 18. In other embodiments, the shaft 20 may be coupled to the button 32 in other ways, including being directly coupled thereto. The button assembly 16 may be of other designs and configurations.

Figure 5:
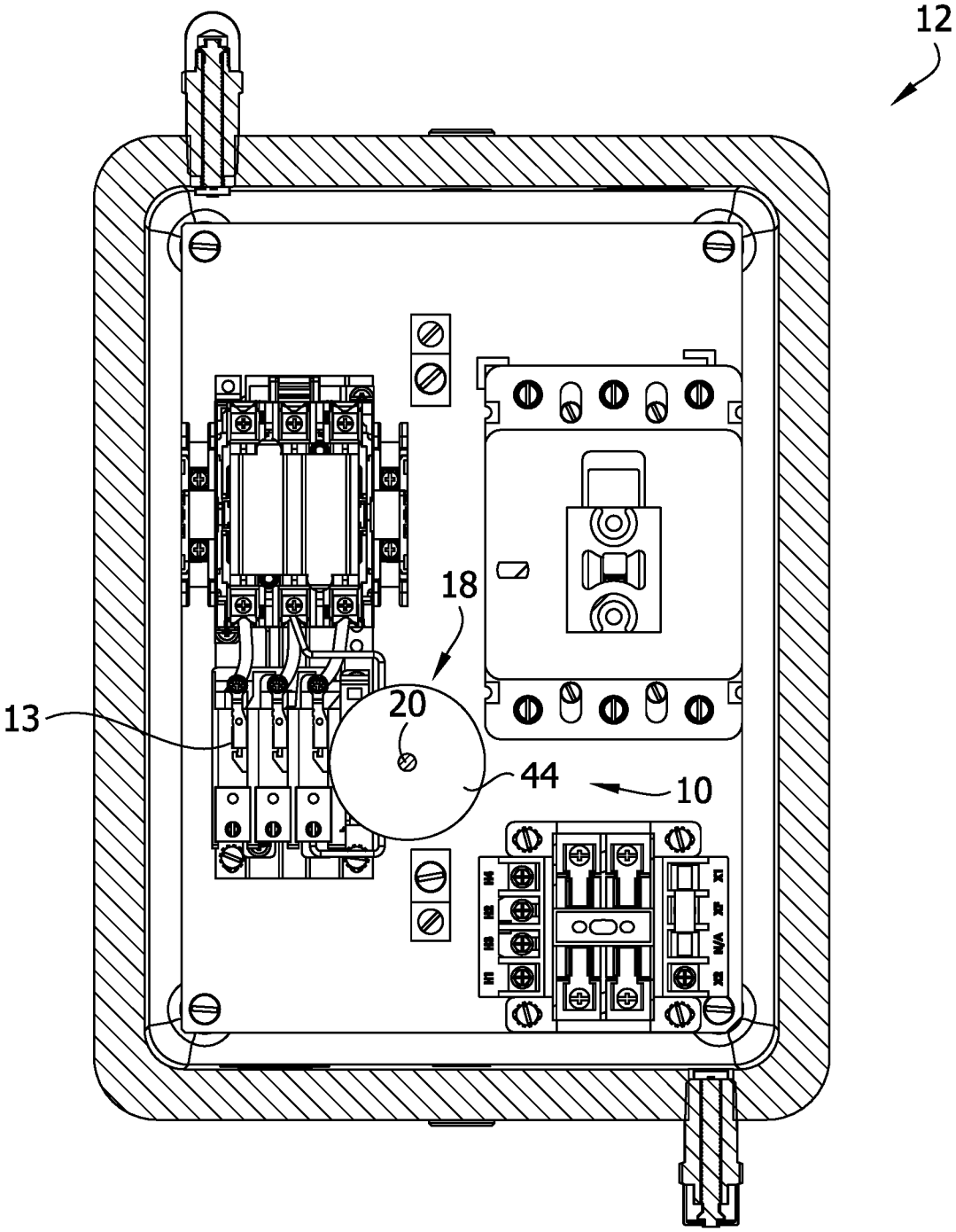
FIG. 5 is a plan section of the control enclosure of FIG. 4.
Figure 6:
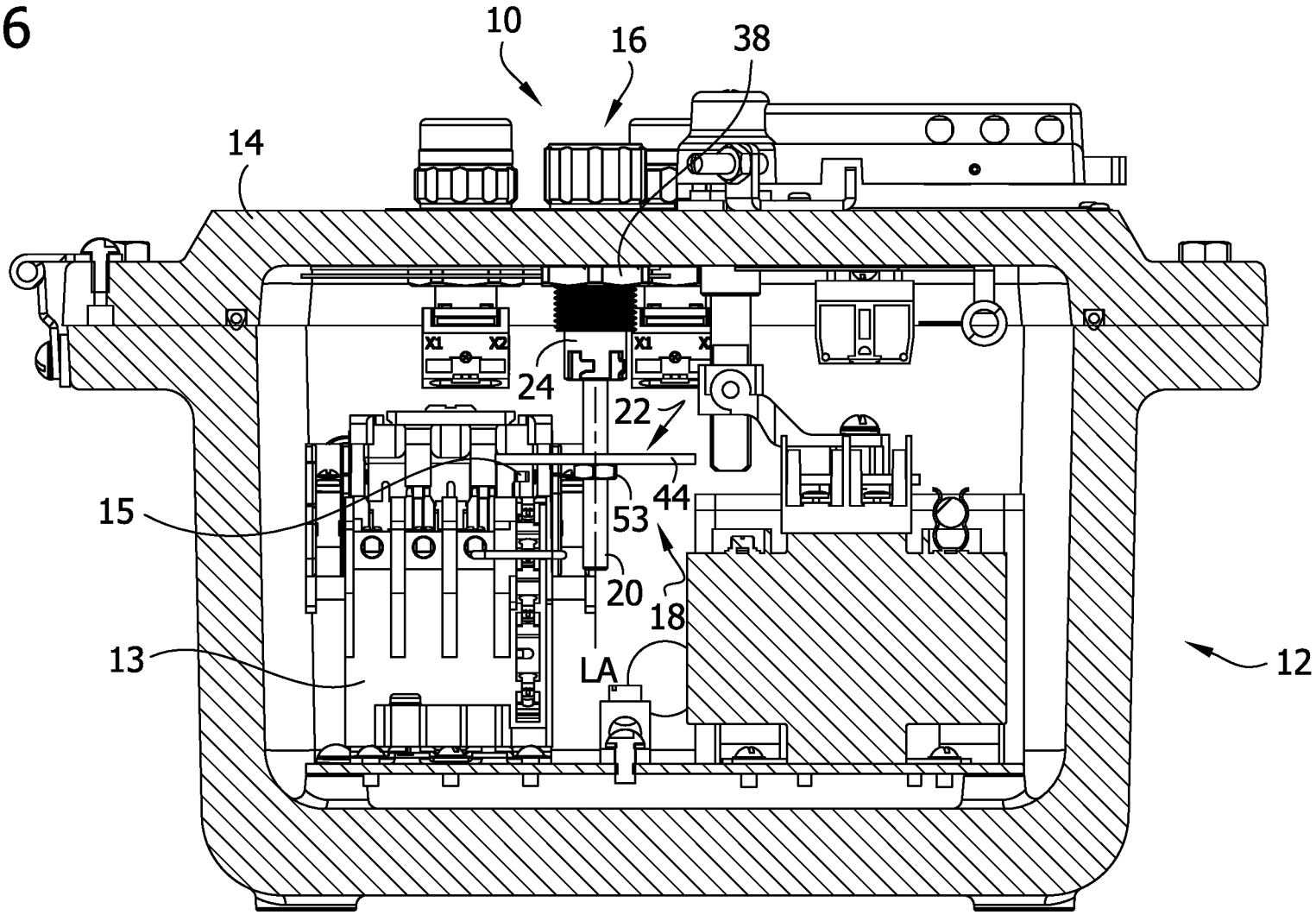
FIG. 6 is a cross section of the control enclosure of FIG. 4.
Figure 7:
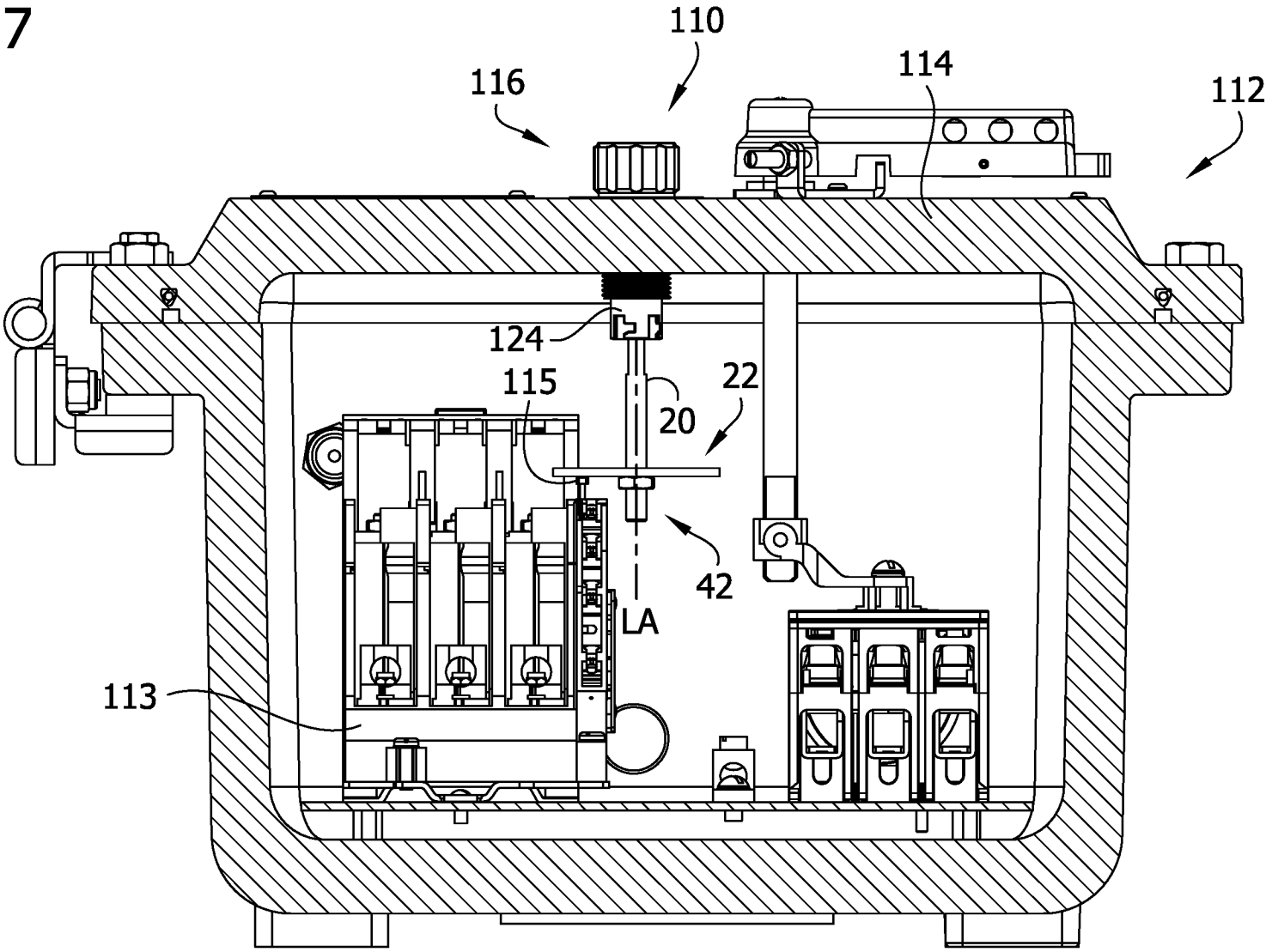
FIG. 7 is a cross section of another embodiment of a control enclosure including another embodiment of an operator mechanism mounted on a door of the control enclosure.
Figure 8:
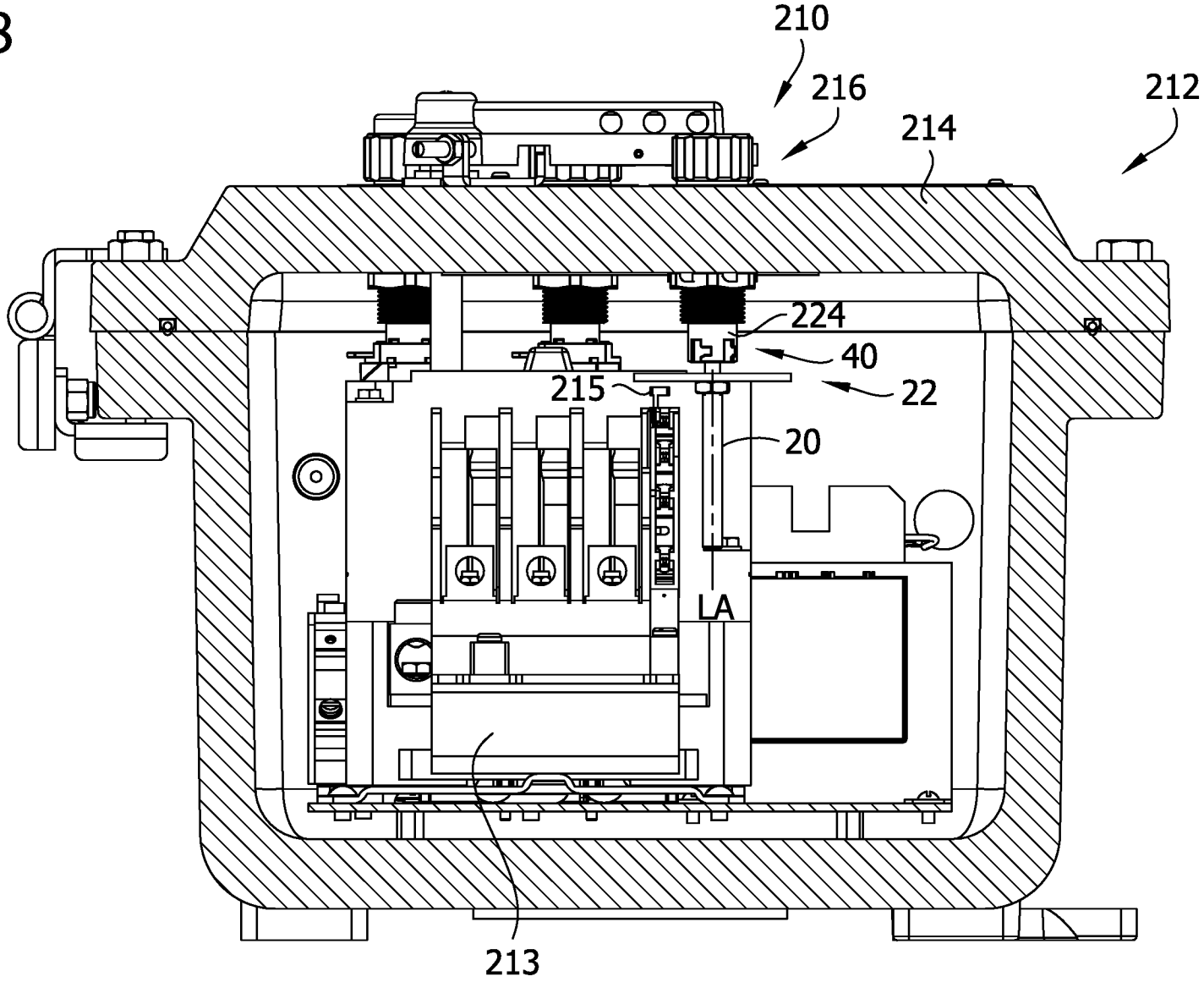
FIG. 8 is a cross section of another embodiment of a control enclosure including another embodiment of an operator mechanism mounted on a door of the control enclosure.

As shown in FIGS. 4-8, the button assembly 16 is configured to mount or secure the operator mechanism 10 on the door 14 or other wall of the control enclosure 12. The body 24 includes an externally threaded section 34 configured to extend through an opening or hole in the door 14 such that the proximal end 26 of the button assembly 16 is positioned outside the interior and the distal end 28 of the button assembly is positioned inside the interior (i.e., the button 32 is positioned proximal of the door 14 or outside the interior of the enclosure 12, accessible to the user). A face plate 36 is secured to the exterior of the body 24, and a mount nut 38 is threaded onto the threaded section 34 of the body 24. The face plate 36 is configured to seat against (e.g., engage) the exterior surface of the door 14 and the mount nut 38 is configured to seat against the interior surface of the door, as shown in FIGS. 6-8, to secure the operator mechanism 10 to the enclosure 12. Other methods of mounting the operator mechanism 10 to the control enclosure 12 are within the scope of the present invention.

Referring to FIGS. 2 and 3, the operator mechanism 10 includes the contact assembly 18 that is coupled or secured to the button assembly 16 such that movement of the button 32 moves the contact assembly. The contact assembly includes a contact member 22 and the shaft 20. The shaft 20 is fully threaded and has a proximal end 40 and a distal end 42. The shaft 20 is coupled to and extends distally from the button assembly 16. As shown in FIG. 3, the proximal end 40 of the shaft 20 is coupled to the shaft attachment portion 33 of the button assembly 16. The shaft 20 defines a threaded hole 41 at the proximal end 40 that is threaded onto the shaft attachment portion 33. In another embodiment, the shaft 20 of the contact assembly 18 extends through body 24 and is coupled directly to the button 32, similar to the prior art in FIGS. 1A and 1B. In this embodiment, the shaft 20 is longitudinally movable or slidable within the body 24. Other ways of attaching the shaft 20 to the button assembly 16 are within the scope of the present disclosure, such as but not limited to making the shaft integral with the button assembly. The shaft 20 extends distally outward from the button assembly 16 to the distal end 42. The shaft 20 has a length L between the proximal and distal ends 40, 42. The shaft 20 defines a longitudinal axis LA.

As shown in FIGS. 2 and 3, the contact member 22 of the contact assembly 18 is coupled to the shaft 20. The contact member 22 is configured to engage an actuator 15 of the control device 13 in the control enclosure when the contact assembly 18 is moved by the mechanical user interface (e.g., the button 32). The contact member 22 extends radially outward from the shaft 20 to engage the actuator 15 of the control device 13. In the illustrated embodiment, the contact member 22 comprises a contact plate 44 having a generally disc shape with an elliptical footprint, as can be seen in FIG. 5. The contact plate 44 has a proximal face 48 and a distal face 50. The contact plate 44 is generally flat with a height H extending parallel to the longitudinal axis LA and a radial extent E (generally, a width) transverse to the height, the height being less than the radial extent. The illustrated contact plate 44 has a circumference 46 (i.e., perimeter edge) greater than the circumference of the shaft 20 (i.e., the diameter of the contact plate is greater than the diameter of the shaft). More broadly, the contact member 22 has an outer radial extent relative to the longitudinal axis LA greater than the outer radial extent of the shaft relative to the longitudinal axis. In the preferred embodiment, the outer radial extent of the contact plate 44 relative to the longitudinal axis LA is at least three times greater than the outer radial extent of the shaft relative to the longitudinal axis. For example, the outer radial extent of the contact plate 44 may be from about three times to about twenty times greater than the outer radial extent of the shaft relative to the longitudinal axis, or at least about 5 times greater than the outer radial extent of the shaft relative to the longitudinal axis, or at least about 6 times greater than the outer radial extent of the shaft relative to the longitudinal axis, or at least 8 times greater than the outer radial extent of the shaft relative to the longitudinal axis, or at least 10 times greater than the outer radial extent of the shaft relative to the longitudinal axis. The contact plate 44 can have other footprint shapes such as, but not limited to, a square or rectangular footprint. The contact plate 44 can also be curved or bent out of plane to adapt the contact member 22 to a particular use or actuator of the control device 13.

The contact member 22 is selectively positionable longitudinally along the shaft 20 to adjust the longitudinal position of the contact member on the shaft. The contact member 22 defines a shaft opening 52 through which the shaft 20 extends. In other words, the distal end 42 of the shaft 20 is distal of the shaft opening 52. The distal end 42 of the shaft 20 may be distal of the proximal and distal faces 48, 50 of the contact plate 44. In the illustrated embodiment, the shaft opening 52 is positioned generally at the center of the contact plate 44. In one embodiment, the shaft opening 52 of the contact plate 44 is threaded such that the contact plate is threaded onto the shaft 20 (e.g., threadably mounted on the shaft). A nut 53 is threaded onto the shaft 20 and engages the distal face 50 of the contact plate 44 to inhibit the contact plate from moving longitudinally along the shaft. In another embodiment, the contact plate 44 can be disposed between nuts threaded onto the shaft 20 that engage the contact plate on either side. In either embodiment, the contact plate 44 can be selectively positioned at any longitudinal position along the length of the shaft (e.g., continuous adjustment) to adjust the operator mechanism 10 to the particular control enclosure 12 and the control device 13 housed therein (i.e. the distance of the actuator 15 of the device from the door 14 as shown in FIGS. 6-8).

Figure 12:
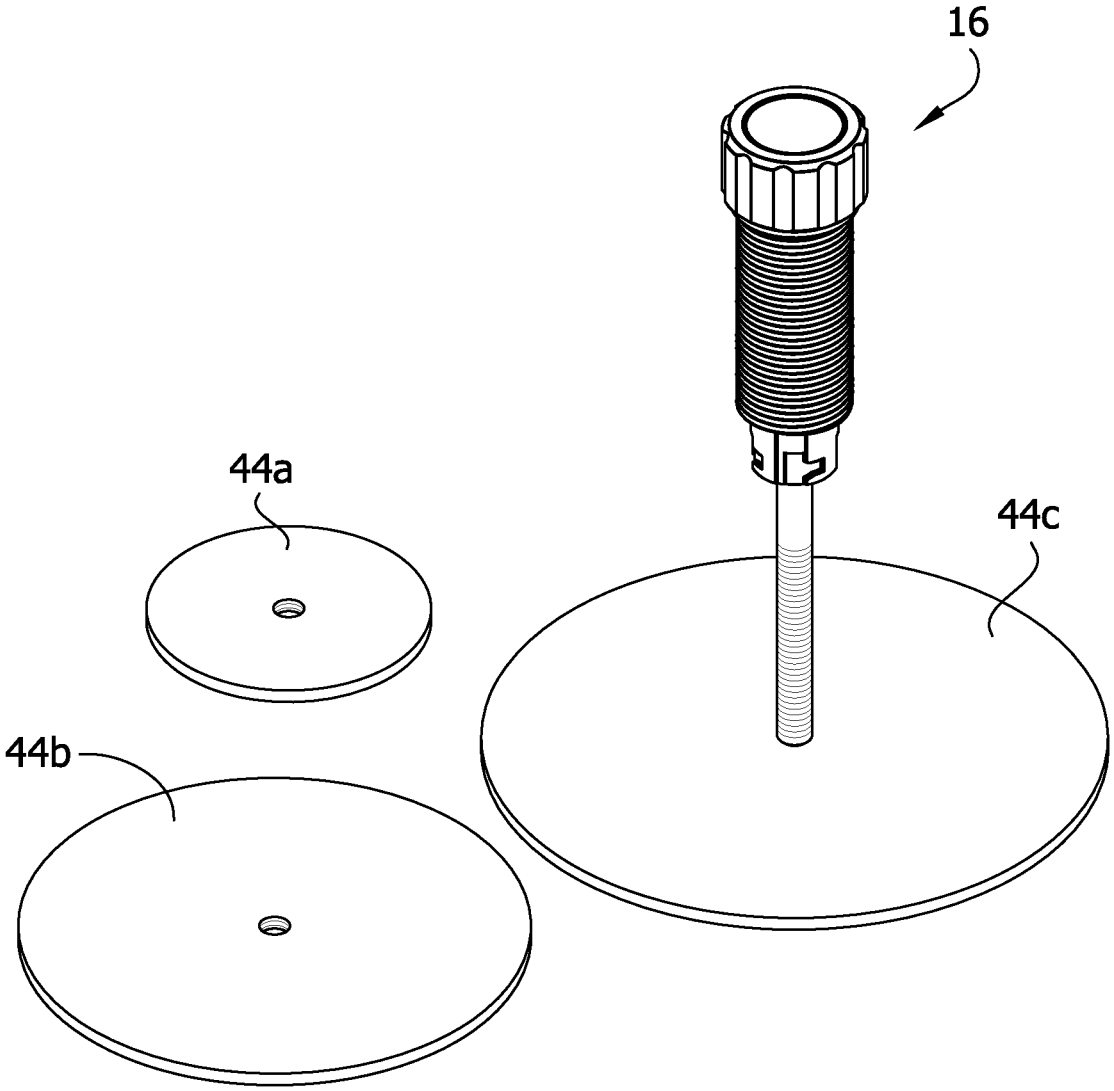
FIG. 12 is a perspective of another embodiment of an operator mechanism constructed according to the teachings of the present disclosure.

The contact member 22 may have an adjustable footprint. The footprint of the contact member 22 can be adjustable to adapt the operator mechanism 10 to the particular control enclosure 12 and the particular position of the actuator 15 of the control device 13 therein. In one embodiment, as shown in FIG. 12, the operator mechanism can include various different contact plates 44*a*, 44*b*, 44*c*, each having a different footprint. In this case, the user selects the contact plate 44*a*, 44*b*, 44*c* with the particular footprint that suits a particular control enclosure 12 and control device. The operator mechanism can include a large footprint contact plate 44*c*, a medium footprint contact plate 44*b*, and a small footprint contact plate 44*a* (i.e. different footprint sizes). Each of these contact plates have a different diameter, such as the outer radial extent of each contact plate relative to the longitudinal axis LA varies. For example, the diameter of the small footprint contact plate may be from about 1 inches (2.5 cm) to about 3 inches (7.6 cm), the diameter of the medium footprint contact plate may be from about 3 inches (7.6 cm) to about 5 inches (12.7 cm), and the diameter of the large footprint contact plate may be from about 5 inches (12.7 cm) to about 8 inches (20.3 cm). Additional and/or different footprints are possible. Moreover, the contact plates can have differently shaped footprints as well. Should the contact plate have an asymmetrical shape, the use of anti-rotation features with the shaft 20 or protruding from the enclosure may be used, as described below. In another embodiment, the footprint of the contact member 22 is adjusted by removing portions thereof (not shown). In this embodiment, the contact plate can have portions configured to be removed by the user to adjust the footprint of the contact plate. For example, the contact plate can have score or perforation lines defining the portions which can be removed by the user.

Figure 11:
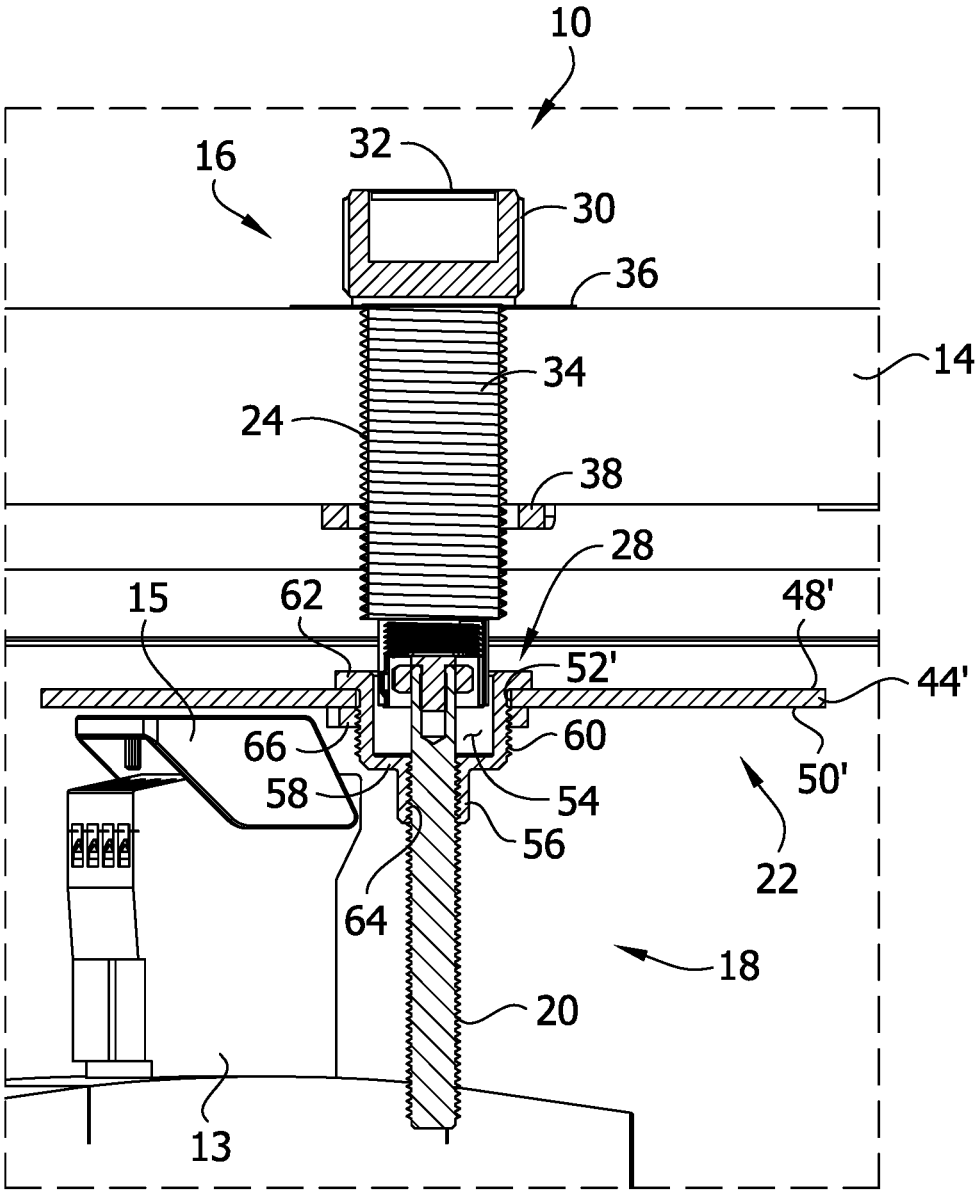
FIG. 11 is a cross section of another embodiment of a control enclosure including another embodiment of an operator mechanism mounted on a door of the control enclosure.

Referring to FIG. 11, in one embodiment the contact member 22 defines a recess 54 sized and shaped to receive the distal end 28 of the button assembly 16. The recess 54 allows the contact member 22 to engage the actuator 15 of the control device 13, when the actuator is proximal of the distal end 28 of the button assembly 16 (i.e. the actuator is adjacent to the door 14). In this embodiment, the contact member 22 comprises a contact plate 44' and an adaptor 56 that connects the contact plate 44' to the shaft 20 adjacent the distal end 28 of the button assembly 16. The contact plate 44' is similar to the contact plate 44 so that similar or analogous elements are labeled with the same reference numerals, with the addition of a trailing prime. The primary difference between contact plates 44 and 44' is the shaft opening 52' is larger than shaft opening 52, to accommodate the adaptor 56. The adaptor 56 radially offsets or radially spaces apart the contact plate 44' from the shaft 20 (i.e., the edge defining the shaft opening 52' has an inner radial extent relative to the longitudinal axis LA that is greater than the outer radial extent of the shaft relative to the longitudinal axis), allowing the distal end 28 of the button assembly 16 to extend through the shaft opening 52' to be received in the recess 54.

The adaptor 56 includes a base 58 defining an adaptor shaft opening 64. The adaptor shaft opening 64 is threaded onto the shaft 20. The base 58 of the adaptor extends radially outward from the shaft 20. A cylindrically shaped outer wall 60 extends perpendicularly from the base 58 to a radially outwardly facing lip 62. The outer wall 60 defines the recess 54. The interior surface of the outer wall 60 is radially spaced apart from the shaft 20 a sufficient distance such that the distal end 28 of the button assembly 16 can be received in the recess 54. That is, the interior surface of the outer wall 60 has an inner radial extent relative to the longitudinal axis LA that is greater than an outer radial extent of the distal end 28 of the button assembly 16 relative to the longitudinal axis). The exterior surface of the outer wall 60 is threaded and configured to extend through the shaft opening 52' of the contact plate 44'. A mount nut 66 is threaded onto the outer wall 60. The mount nut 66 is configured to seat against the distal face 50' of the contact plate 44' and the lip 62 is configured to seat against the proximal face 48' of the contact plate 44 to secure the contact plate to the adaptor 56. It is understood the adaptor 56 can be selectively positioned at any longitudinal position long the shaft 20. For example, in one embodiment, the adaptor 56 and contact plate 44' are turned upside-down (from the orientation shown in FIG. 11) and the adaptor coupled adjacent to the distal end 42 of the shaft 20 to position the contact plate 44' distal of the shaft. Moreover, the adaptor 56 and contact plate 44' can be formed in one-piece construction (i.e. a single component, not two separate components) such that the contact plate itself defines the recess 54.

Each of the components of the operator mechanism 10 can be formed from any suitable material, including, but not limited to, metal and plastic. In one example, all of the components may be made from metal. The components may be formed from other suitable materials.

In use, as shown in FIGS. 4-6, the operator mechanism 10 is attached to the door 14 of the panel enclosure 12 such that a proximal end of the operator mechanism is outside the interior of the enclosure and a distal end of the operator mechanism is inside the interior of the enclosure. The body 24 of the button assembly 16 extends through an opening in the door 14 (e.g., the wall) of the control enclosure 12. The face plate 36 engages the exterior surface of the door 14 and the mount nut 38 is tightened against the interior surface of the door, to mount the operator mechanism 10 on the door. The longitudinal position of the contact member 22 is adjusted to account for the location (e.g., height) of the actuator 15 of the device 13 in the control enclosure 12. For example, for a push button operator mechanism 10, the contact member 22 is longitudinally adjusted on the shaft 20 such that the contact member will engage or contact the actuator 15 when the contact assembly 18 is moved distally as the button 32 is depressed. In the illustrated embodiment, the contact member 22 is positioned near the middle of the shaft 20 to engage the actuator 15 (FIG. 6). To adjust the position of the contact member 22, the contact plate 44 and/or nut(s) 53 are threaded (rotated) on the shaft 20 to move the contact member into the desired position. As shown in FIG. 6, the opening in the door is not aligned with the actuator 15 of the control device 13 such that the actuator is radially spaced apart (e.g., offset) from the longitudinal axis LA of the shaft 20. The contact member 22 extends radially outward from the shaft 20 such that the contact member overlies at least a portion of the actuator 15. In other words, when the operator mechanism 10 is attached to the door 14 of the control enclosure 12, the actuator 15 of the device 13 has an inner radial extent relative to the longitudinal axis LA that is less than the outer radial extent of the contact member 22 relative to the longitudinal axis. In the illustrated embodiment, the contact member 22 completely overlies the actuator (FIG. 6). When the button 32 is depressed, moving the contact member 22, the portion of the contact member overlying the actuator 15 engages the actuator. Thus, the operator mechanism 10 is able to engage an actuator 15 that is laterally or radially offset from the shaft of the operator mechanism and is adjacent to the door 14, adjacent to the floor (i.e. the wall of the enclosure 12 opposite the door), or anywhere in-between from a single position (i.e. hole) in the door.

When installed, the shaft 20 of the operator mechanism 10 can rotate relative to the button assembly 16. Accordingly, in the preferred embodiment, the contact member 22 has a circular footprint so that regardless of any shaft 20 rotation, a portion of the contact member 22 will always overlie and be able to engage the actuator 15 of the control device 13. In another embodiment, the operator mechanism 10 includes an anti-rotation mechanism or other ways to inhibit rotation of the shaft 20 relative to the button assembly 16. The anti-rotation feature ensures the contact member will stay in an overlapping arrangement with the actuator 15. Thus, the contact member 22 can have other footprints, as described above. Further details on suitable anti-rotation features are described in U.S. Patent Publication No. 2018/0232004, the entirety of which is hereby incorporated by reference.

Referring to FIGS. 7 and 8, additional embodiments of an operator mechanism are generally indicated at reference numerals 110 and 210, respectively. The operator mechanisms 110, 210 are similar to operator mechanism 10, described above, except the operator mechanisms 110, 210 are mounted to control enclosures 112 and 212, respectively. Control enclosures 12, 112 and 212 have different sizes and different control devices such that the actuator 15, 115, 215 of each control device 13, 113, 213 is in a different position relative to the operator mechanism 10, 110, 210, respectively. Accordingly, the contact member 22 of each operator mechanisms 110, 210 have different positions on the shaft 20 (relative to each other and operator mechanism 10) in order to engage the actuator 115, 215 in each control enclosure 112, 212, respectively. As shown in FIG. 7, the contact member 22 of the operator mechanism 110 is positioned on the shaft 20 near the distal end 42. Moreover, as shown in FIG. 8, the contact member 22 of the operator mechanism 210 is positioned on the shaft 20 near the proximal end 40. In addition, compared to operator mechanism 10, operator mechanisms 110, 210 have button assemblies 116, 216 with longer bodies 124, 224 to extend through the thicker doors 114 and 214 of control enclosures 112, 212, respectively. Operator mechanisms 110, 210 can also have a different shaft and a different contact member than operator mechanism 10.

Figure 9:
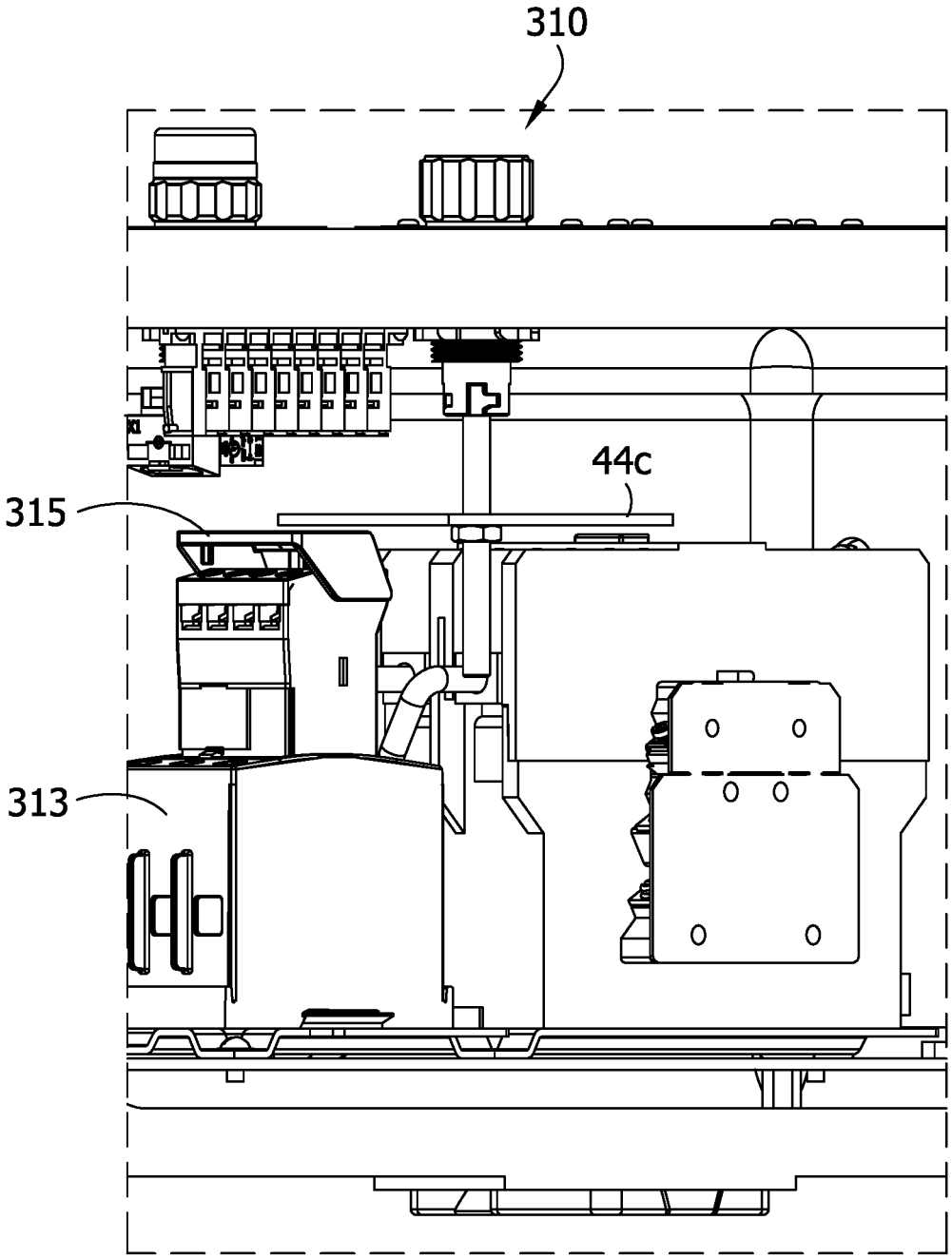
FIG. 9 is a cross section of another embodiment of a control enclosure including another embodiment of an operator mechanism mounted on a door of the control enclosure.
Figure 10:
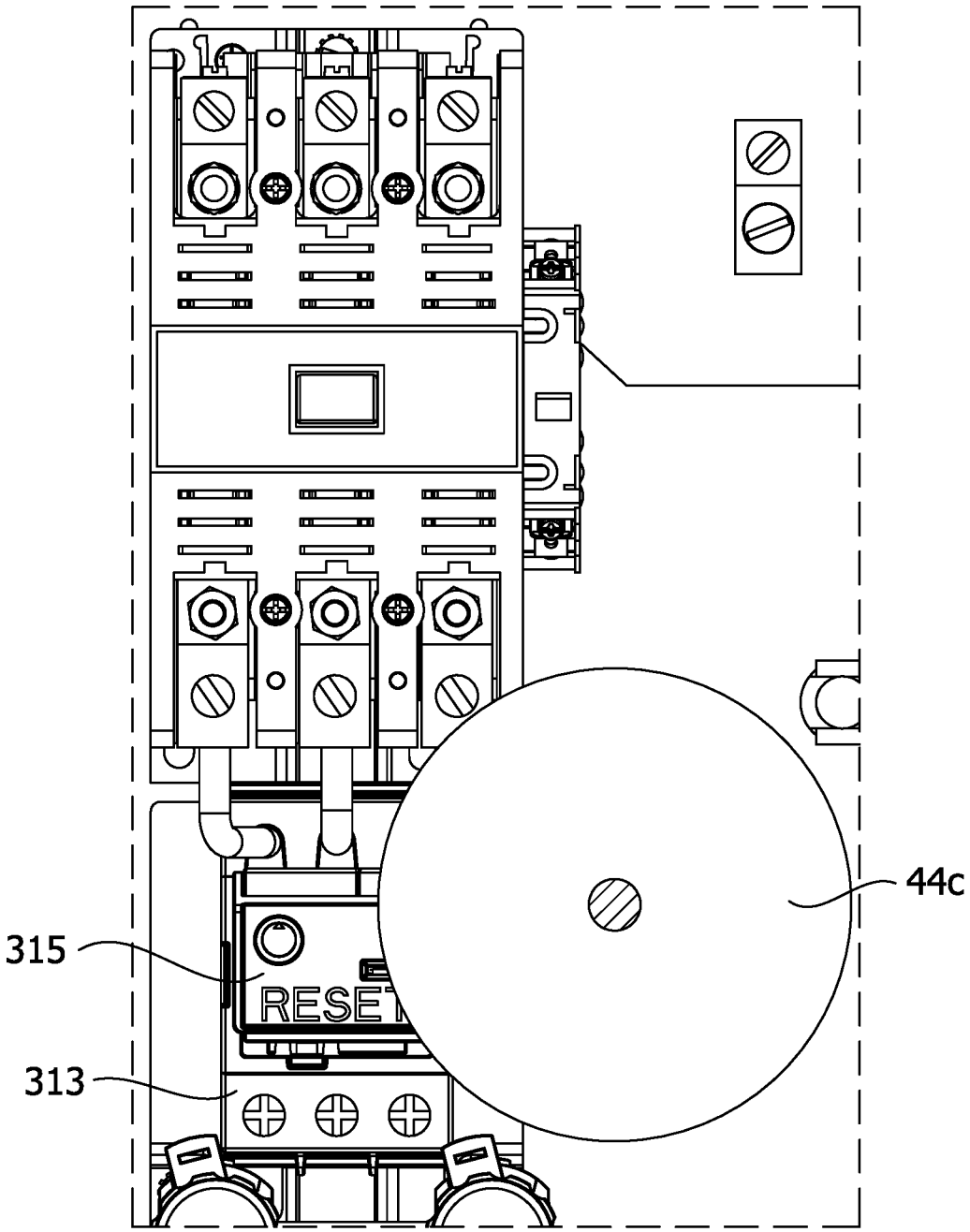
FIG. 10 is a plan section of the control enclosure of FIG. 9.

Referring to FIGS. 9 and 10, another embodiment of an operator mechanism is generally indicated at reference numeral 310. Operator mechanism 310 is similar to operator mechanism 10, described above, except operator mechanism 310 has a large footprint contact plate **44*c* (FIG. 10). The operator mechanism 310 is mounted on the door 314 of the control enclosure 312 and is configured to engage the actuator 315 of the control device 313. In this embodiment, the actuator is a lever-type actuator and the contact plate 44*c*** overlies a portion of the actuator.

Referring to FIG. 11, the operator mechanism 10 with the adaptor 56 is mounted on the door 14 of the control enclosure 12. In this embodiment, the actuator 15 of the control device 13 is positioned adjacent to the interior surface of the door 14 such that the actuator is proximal of the distal end 28 of the button assembly 16. The adaptor 56 is attached to the shaft 20 adjacent the distal end 28 of the button assembly 16 such that the distal end is partially received in the recess 54. As shown in FIG. 11, the adaptor positions the contact plate 44' proximal of the actuator 15 such that the contact plate will engage the actuator when moved in the distal direction.

As a result of the operator mechanism 10 ability to engage an actuator 15 that is radially spaced apart from the shaft 20, the operator mechanism and actuator do not need to be longitudinally aligned (i.e. the shaft 20 does not need to be aligned with the actuator). This creates greater flexibility in the construction of control enclosures. For example, instead of individually aligning the opening in the door to the particular location of the actuator 15 in the enclosure for conventional operator mechanisms, the operator mechanism 10 allows the same opening location in the door to be used with numerous different actuator locations. This reduces the number of different enclosures that need to be constructed—saving time and money. In addition, as shown in FIGS. 6-8, the shaft 20 of the operator mechanism 10 is no longer limited in length by the control device because the shaft can be offset or placed to the side of the device. This allows a standard length shaft to be used for a wide variety of different control devices without having to vary or adjust the length of the shaft or an extender thereon (prior art, FIGS. 1A and 1B). This also allows the depth of the enclosure to be reduced because of the ability to engage an actuator located adjacent the door (i.e. space above the actuator for the entire operator mechanism is no longer required). Moreover, the ability to adjust the position of the contact member 22 on the shaft 20 allows the operator mechanism 10 to be used with a numerous different control enclosures and control devices.

The operator mechanism may be of other types, besides a push button operator mechanism, that incorporate the teachings set forth herein for the offset arrangement of the operator mechanism. For example, the operator mechanisms can be a pull button operator mechanism that is moved by the user in the proximal direction to engage an actuator of a control device.

In view of the above, it will be seen that the several features of the invention are achieved and other advantageous results obtained.

Modifications and variations of the disclosed embodiments are possible without departing from the scope of the invention defined in the appended claims. For example, where specific dimensions are given, it will be understood that they are exemplary only and other dimensions are possible.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An operator mechanism for a control enclosure, the operator mechanism having proximal and distal ends and comprising:

a mechanical user interface adjacent the proximal end of the operator mechanism and configured to be physically moved by a user to actuate the operator mechanism;

a contact assembly coupled to the mechanical user interface such that movement of the mechanical user interface by the user imparts movement to the contact assembly in one of distal and proximal directions, the contact assembly including a shaft having a longitudinal axis extending distally outward relative to the mechanical user interface to a distal end of the shaft; and a contact member coupled to and extending radially outward from the shaft and configured to engage an actuator of a control device in the control enclosure when the contact assembly is moved in said one of the distal and proximal directions by the mechanical user interface;

wherein the shaft is threaded and the contact member includes a threaded shaft opening, the contact member being threadably mounted on the shaft such that the shaft extends through the shaft opening of the contact member and extends distally past the contact member.

2. The operator mechanism of claim 1, wherein the contact member is selected from a group including a large footprint contact member, a medium footprint contact member, and a small footprint contact member to adjust the footprint of the contact member.

3. The operator mechanism of claim 1, wherein the contact member is selectively positionable longitudinally along the shaft to adjust a longitudinal position of the contact member on the shaft.

4. The operator mechanism of claim 3, wherein the shaft is threaded and the contact member includes a threaded shaft opening, the contact member being threadably mounted on the shaft such that the shaft extends through the shaft opening of the contact member, and wherein the operator mechanism further comprises a nut threadably mounted on the shaft and engaging the contact member to inhibit the contact member from moving longitudinally along the shaft.

5. An operator mechanism for a control enclosure, the operator mechanism having proximal and distal ends and comprising:

a mechanical user interface adjacent the proximal end of the operator mechanism and configured to be physically moved by a user to actuate the operator mechanism; and a contact assembly coupled to the mechanical user interface such that movement of the mechanical user interface by the user imparts movement to the contact assembly in one of distal and proximal directions, the contact assembly including a shaft having a longitudinal axis extending distally outward relative to the mechanical user interface to a distal end of the shaft; and a contact member coupled to and extending radially outward from the shaft and configured to engage an actuator of a control device in the control enclosure when the contact assembly is moved in said one of the distal and proximal directions by the mechanical user interface, the contact member being selectively positionable longitudinally along the shaft to adjust a longitudinal position of the contact member on the shaft, the contact member defining a shaft opening extending through the contact member, wherein the shaft extends through the shaft opening such that the distal end of the shaft is distal of the shaft opening, wherein the contact member includes a radial wall defining a recess at the center of the contact member, the radial wall having an inner radial extent relative to the longitudinal axis that is greater than an outer radial extent of the shaft relative to the longitudinal axis.

6. The operator mechanism of claim 5, wherein the contact member has an outer radial extent relative to the longitudinal axis of the shaft that is at least about 5 times greater than an outer radial extent of the shaft relative to the longitudinal axis of the shaft.

7. The operator mechanism of claim 5, wherein the contact member comprises a contact plate, wherein the shaft opening extends through a center of the contact plate.

8. The operator mechanism of claim 5, wherein the contact member has a height extending longitudinally and an extent transverse to the height, wherein the height of the contact member is less than the extent of the contact member.

9. The operator mechanism of claim 5, wherein the contact member has an adjustable footprint.

10. The operator mechanism of claim 5, wherein the shaft and the shaft opening are threaded and the contact member is threadably mounted on the shaft.

11. The operator mechanism of claim 10, wherein the contact assembly further comprises a nut threadably mounted on the shaft and engaging the contact member to inhibit the contact member from moving longitudinally along the shaft.

12. The operator mechanism of claim 5, wherein the contact member comprises an adaptor and a contact plate, the adaptor coupled to and extending radially outward from the shaft, the adaptor including the radial wall defining the recess, the contact plate coupled to and extending radially outward from the adaptor, the adaptor radially spacing apart the contact plate from the shaft.

13. The operator mechanism of claim 12, wherein the operator mechanism further includes a body having a proximal end and a distal end, the distal end of the body positioned adjacent to the shaft, the radial wall having an inner radial extent relative to the longitudinal axis that is greater than an outer radial extend of the distal end of the body relative to the longitudinal axis, wherein a portion of the contact member is located proximally of the distal end of the body.

* * * * *